US008221163B2

(12) United States Patent
Kawakami et al.

(10) Patent No.: US 8,221,163 B2
(45) Date of Patent: Jul. 17, 2012

(54) ELECTRICAL CONNECTOR HAVING A SHIELD CASE WITH IMPEDANCE ADJUSTER

(75) Inventors: Yuta Kawakami, Yao (JP); Takayuki Nagata, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 13/097,353

(22) Filed: Apr. 29, 2011

(65) Prior Publication Data

US 2011/0294349 A1 Dec. 1, 2011

(30) Foreign Application Priority Data

Jun. 1, 2010 (JP) ..... 2010-125755

(51) Int. Cl.
*H01R 13/648* (2006.01)

(52) U.S. Cl. ..... 439/607.13

(58) Field of Classification Search ..... 439/607.02–607.13; 361/800; 174/35 R See application file for complete search history.

(56) References Cited

U.S. PATENT DOCUMENTS

| | | | | |
|---|---|---|---|---|
| 5,387,114 | A * | 2/1995 | Brunker et al. | 439/108 |
| 6,164,995 | A * | 12/2000 | Peloza | 439/188 |
| 7,597,563 | B2 * | 10/2009 | Shinkawa et al. | 439/98 |
| 7,938,683 | B2 * | 5/2011 | Nagata | 439/607.13 |
| 2002/0022407 | A1 * | 2/2002 | Niitsu et al. | 439/676 |
| 2010/0233905 | A1 * | 9/2010 | Nagata | 439/607.13 |

FOREIGN PATENT DOCUMENTS

JP 2009-181733 A1 8/2009

* cited by examiner

*Primary Examiner* — Chandrika Prasad
(74) *Attorney, Agent, or Firm* — Kratz, Quintos & Hanson, LLP

(57) ABSTRACT

The invention provides a connector including a body having an insulating property; a terminal group provided in the body; and a shield case having electrical conductivity. The terminal group includes a first terminal, and a second terminal, being provided adjacent to the first terminal and having higher impedance than the first terminal. The shield case includes an outer shell, configured to surround an peripheral surface of the body, and an impedance adjuster, provided at the outer shell and located adjacent to at least a portion of the second terminal and on an opposite side of the second terminal from the first terminal.

15 Claims, 7 Drawing Sheets

ELECTRICAL CONNECTOR HAVING A SHIELD CASE WITH IMPEDANCE ADJUSTER

The present application claims priority under 35 U.S.C. §119 of Japanese Patent Application No. 2010-125755 filed on Jun. 1, 2010, the disclosure of which is expressly incorporated by reference herein in its entity.

BACKGROUND OF THE INVENTION

1. Technical Field

The present invention relates to a connector having a plurality of terminals.

2. Background Art

A conventional connector includes a body having an insulating property, a conductive shield case surrounding the body, and a terminal group provided in the body. The terminal group has a plurality of first and second terminals adjacent to each other serving as differential pairs. The second terminal of the differential pair positioned at an end of the pairs is positioned at an end of the terminal group. Although the first terminal of the same differential pair exists on the inner side from the second terminal, there is no adjacent terminal on the outer side from the second terminal. The second terminal therefore has higher impedance than the first terminal. As a result, impedance mismatch occurs between the first and second terminals of the endmost differential pair, and the impedance characteristics of the first and second terminals of the endmost differential pair is different from impedance characteristics of the first and second terminals of other differential pairs.

This problem may be solved in a connector as disclosed in Japanese Unexamined Patent Publication No. 2009-181733. More particularly, a ground terminal is provided next to the first and second terminals to equalize the impedance characteristics between the first and second terminals in each differential pair, resulted in matched impedances of the first and second terminals in all the differential pairs.

CITATION LIST

Patent Literature 1: Japanese Unexamined Patent Publication No. 2009-181733

SUMMARY OF INVENTION

However, the addition of the ground terminal should lead to increase in the number of components and in complexity of the entire configuration of the connector. These increases will lead to increased cost of the connector.

The present invention has been devised in light of the above-described situation. The invention provides a connector having terminals subject to impedance matching matched in impedance without increasing the number of components.

In order to solve the above-described problem, a connector of the present invention includes a body having an insulating property; a terminal group provided in the body; and a shield case having electrical conductivity. The terminal group includes a first terminal, and a second terminal, being provided adjacent to the first terminal and having higher impedance than the first terminal. The shield case includes an outer shell, configured to surround an peripheral surface of the body, and an impedance adjuster, provided at the outer shell and located adjacent to at least a portion of the second terminal and on an opposite side of the second terminal from the first terminal.

The connector of the invention is advantageous in that the impedance of the second terminal can be lowered without adding a separate component because the impedance adjuster forming part of the shield case is placed adjacent to at least a portion of the second terminal and on the opposite side of the second terminal from the first terminal. Therefore, the invention makes it possible to match impedances between the first and second terminals.

The outer shell may include first and second outer shells. The body may include a main body, the main body including a front portion and a rear portion. The second outer shell may include a tuboid containing portion adapted to contain the front portion of the main body. The first outer shell may include a base adapted to cover at least a portion of the rear portion of the main body. An opening may be provided in the base or the containing portion. A lid for closing the opening may be provided in the containing portion or the base. The impedance adjuster may stand on an edge of the opening.

In this aspect of the invention, the containing portion of the second outer shell contains the front portion of the main body, and the base of the first outer shell covers at least a portion of the rear portion of the main body. The impedance adjuster, standing on the edge of the opening in the base or in the containing portion, is positioned adjacent to the second terminal, and the opening is covered with the lid of the containing portion or of the base. Such configuration can avoid interference between the impedance adjuster and the second or first outer shell. Thus, the connector in this aspect of the invention is advantageously easy to assemble.

The impedance adjuster may not be provided on the edge of the opening, but it may be provided on the lid and received in the opening. Also in this case, it is possible to cover the opening with the lid and place the impedance adjuster into the opening and adjacent to the second terminal when the containing portion of the second outer shell receives the front portion of the main body and the base of the first outer shell covers at least a portion of the rear portion of the main body. Such configuration can also avoid interference between the impedance adjuster and the second or first outer shell. Thus, the connector in this aspect of the invention is advantageously easy to assemble.

The base may abut a lower surface of the rear portion of the main body. The containing portion may include a first plate abutting upper surfaces of the front portion and the rear portion of the main body, a second plate shorter than the first plate, the second plate abutting a lower surface of the front portion of the main body, and third and fourth plates abutting opposite side surfaces of the front portion of the main body. The second outer shell may further include a pair of covers provided continuously to the first plate or the third and fourth plates, the covers abutting opposite side surfaces of the rear portion.

In this aspect of the invention, when the containing portion contains the front portion of the main body, the first plate abuts the upper surfaces of the front portion and the rear portion of the main body, the second plate abuts the lower surface of the front portion of the main body, the third and fourth plates abut the side surfaces of the front portion of the main body, and the covers abut the side surfaces of the rear portion of the main body. Thereafter, simply by bringing the base into abutment with the lower surface of the rear portion of the main body, the peripheral surface of the main body will be covered by the first and second outer shells. Consequently, the connector in this aspect of the invention is advantageously easy to assemble.

The first outer shell may further include a pair of locking portions standing on the base. The locking portions may be locked to the covers. In this aspect of the invention, the first and second outer shells can be combined with each other and attached to the body only by bringing the base into abutment with the lower surface of the rear portion of the main body and locking the locking portions to the covers. Consequently, the connector in this aspect of the invention is advantageously easy to assemble.

The terminal group may include a plurality of terminals including the first terminal and the second terminal. The connector may further include a cable including a plurality of signal lines, the signal lines being connected to the terminals, and a shield conductor covering the signal lines. The first and second outer shells may be in contact with each other. At least one of the first and second outer shells may further include a connection portion to be brought into contact with the shield conductor. This aspect of the invention is advantageous in ease of ground connection of the first and second outer shells. Particularly, the first and second outer shells can be ground connected simply by bringing the connection portion into contact with the shield conductor of the cable. Further, as the first and second outer shells are ground connected, there exists no floating ground.

The body may include a slit on the opposite side of the second terminal from the first terminal. The slit may be adapted to receive the impedance adjuster. In this aspect of the invention, the impedance adjuster can be placed adjacent to at least the portion of the second terminal and on the opposite side of the second terminal from the first terminal, simply by inserting the impedance adjuster into the slit of the body when attaching the first and second outer shells to the body. Consequently, the connector in this aspect of the invention is advantageously easy to assemble.

Alternatively, the impedance adjuster may be embedded in the body. In this aspect of the invention, the impedance adjuster embedded in the body will be placed adjacent to at least the portion of the second terminal and on the opposite side of the second terminal from the first terminal. Consequently, the connector in this aspect of the invention is advantageously easy to assemble.

The terminal group may have a plurality of terminals arrayed in first and second rows. The second terminal may be positioned at an end of the terminals in the first or second row. The first terminal may be positioned in the same row as the second terminal and on an inner side from the second terminal.

The terminal group may further include a third terminal positioned in a different row from the first and second terminals and between the first and second terminals in plan position. The first and second terminals may serve as a differential pair. In this aspect of the invention, as there is no adjacent terminal outside the second terminal, impedance of the second terminal should be higher than impedance of the first terminal. However, this aspect of the invention can lower the impedance of the second terminal because the impedance adjuster being a portion of the shield case is placed adjacent to at least the portion of the second terminal and on the opposite side of the second terminal from the first terminal. Therefore, the impedances are matched between the first and second terminals serving as a differential pair.

DESCRIPTION OF EMBODIMENTS

Figure 1:
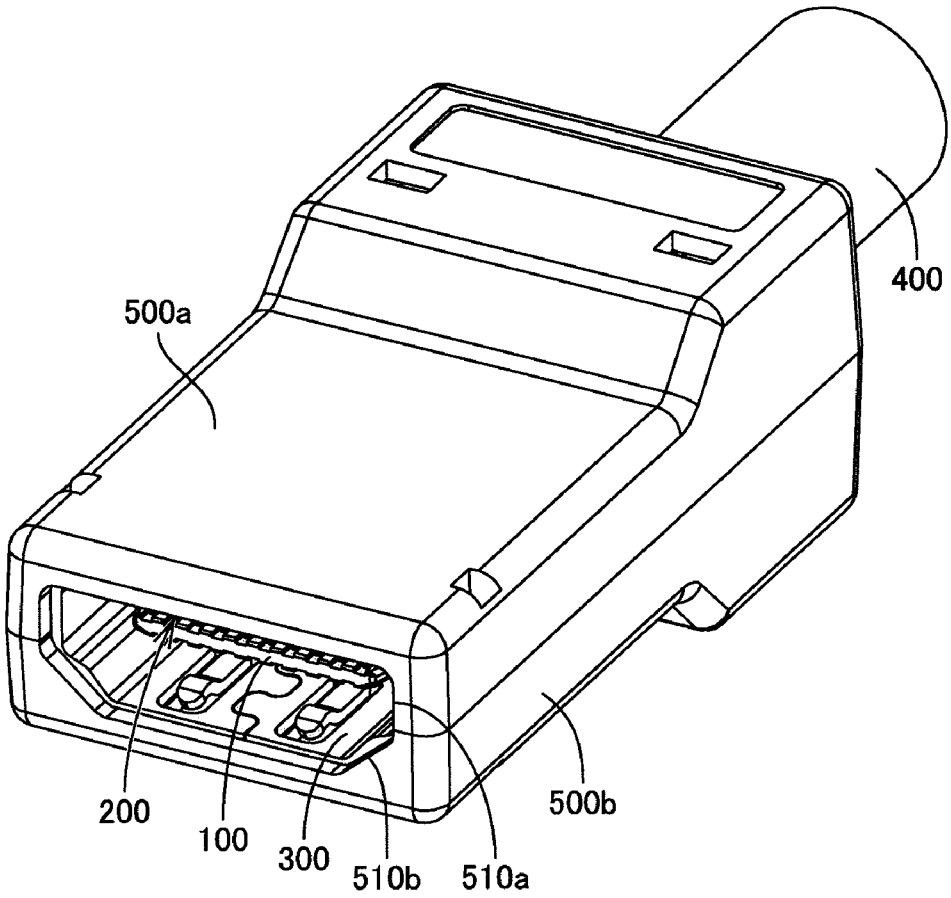
FIG. 1 is a schematic perspective view of a connector according to an embodiment of the present invention, as seen from the front top right side.
Figure 2A:
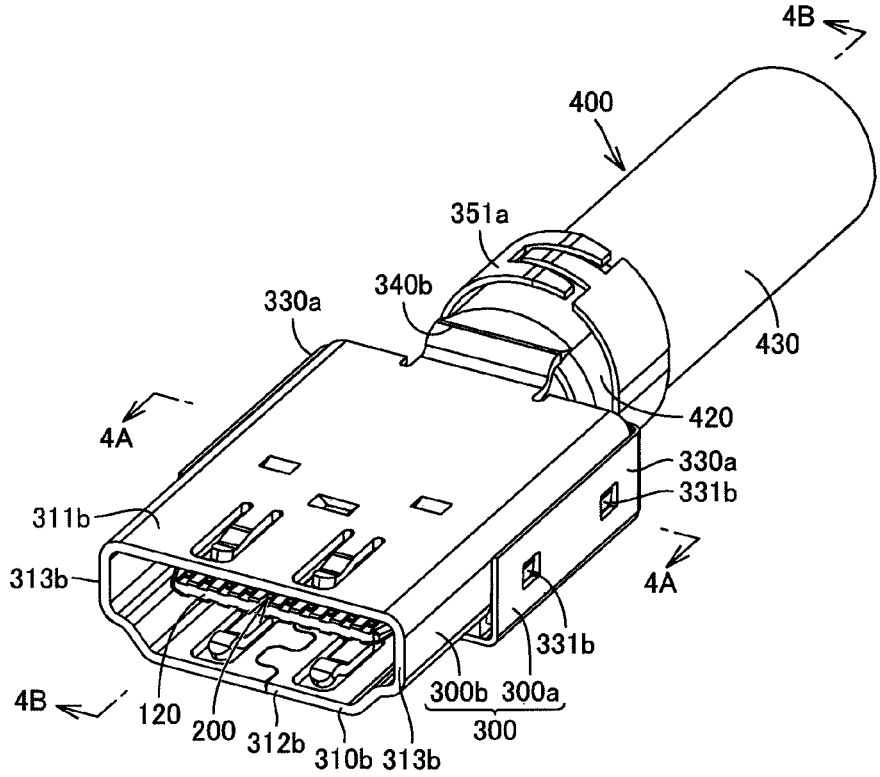
FIG. 2A is a schematic perspective view of the connector with its resin cases removed, as seen from the front top right side.
Figure 2B:
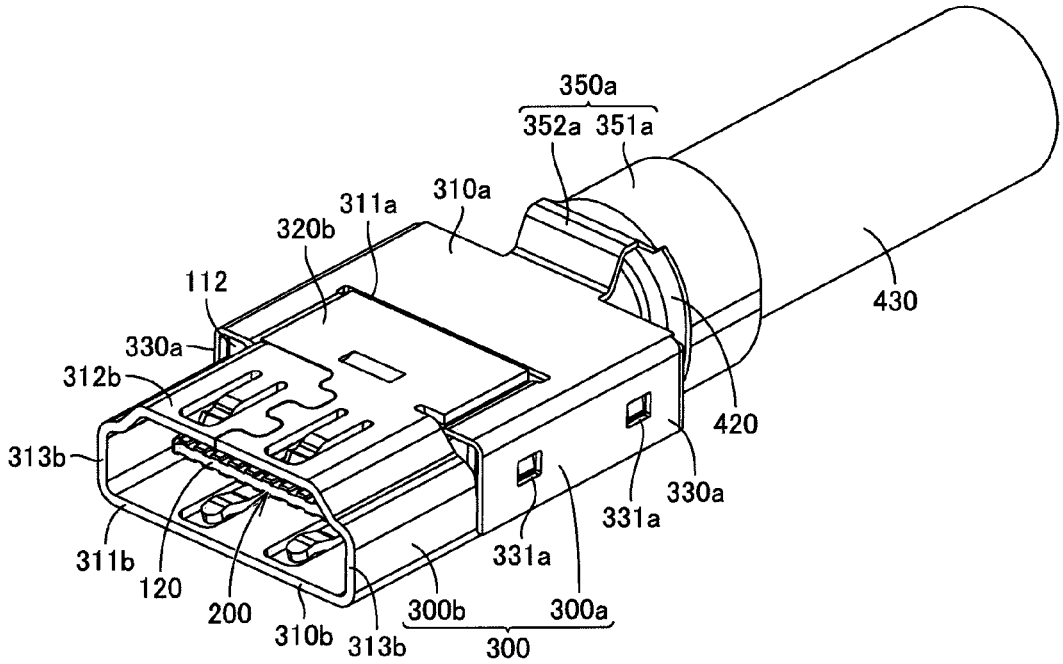
FIG. 2B is a schematic perspective view of the connector with its resin cases removed, as seen from the front bottom left side.
Figure 3A:
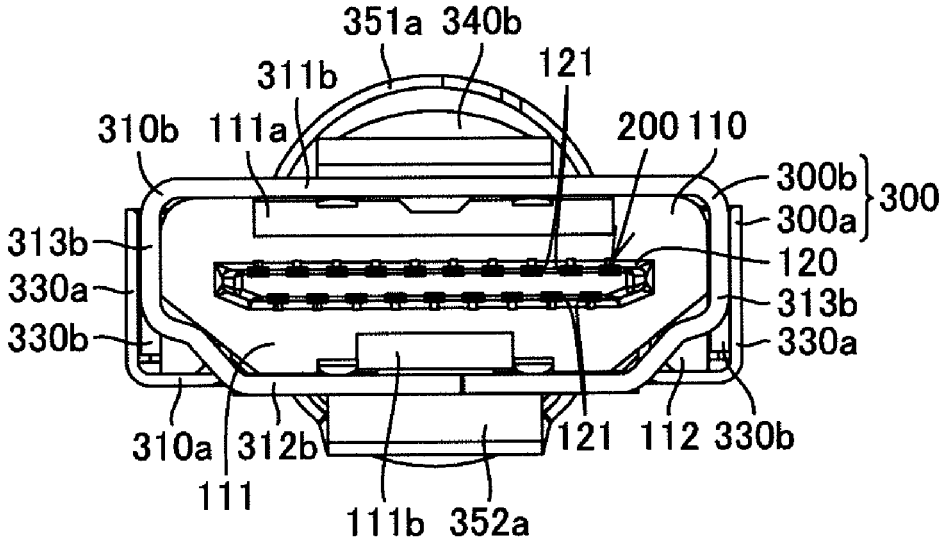
FIG. 3A is a schematic front view of the connector with its resin cases and cable removed.
Figure 3B:
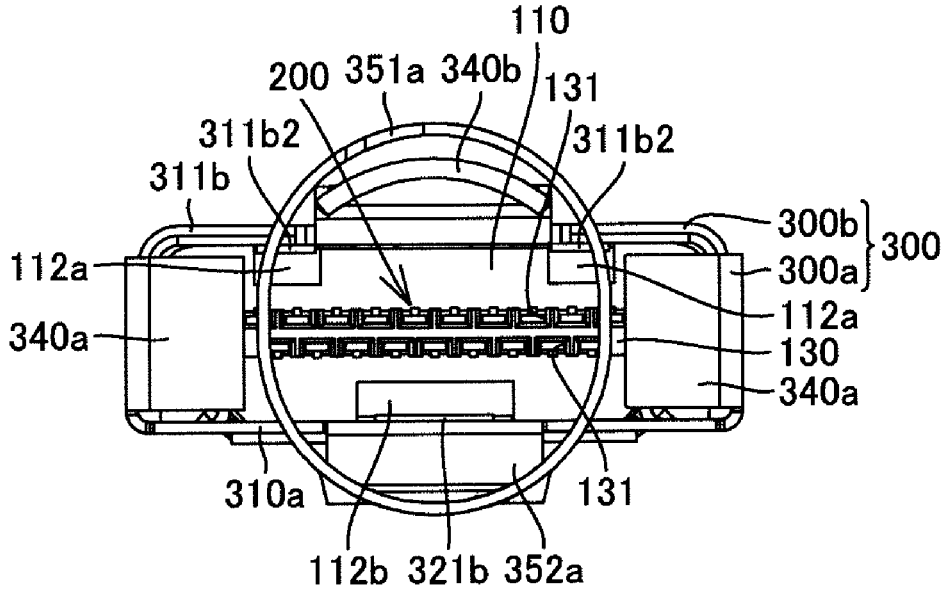
FIG. 3B is a schematic back view of the connector with its resin cases and cable removed.

A connector according to an embodiment of the present invention will be described below with reference to FIGS. 1 to 7B. A connector shown in FIGS. 1 to 3B is a receptacle connector compliant with HDMI (registered trademark) Type A standard. The connector includes a body 100, a terminal group 200, a shield case 300, a cable 400, and resin cases 500*a*, 500*b*. Respective components of the connector will be described in detail below.

The body 100 is an injection-molded article made of insulating resin and contained in the shield case 300. This body 100 has a main body 110, a front projection 120, and a rear projection 130 as shown in FIGS. 3A to 5B. The main body 110 has a substantially hexagonal front portion 111, and a rectangular rear portion 112 provided continuously to the front portion 111. A plurality of press-fit holes 113 pass through the main body 110 in the anteroposterior direction. The press-fit holes 113 are arranged in two (upper and lower) rows in the middle of the front portion 111 and the rear portion 112 so as to form a staggered arrangement. The tabular front projection 120 projects from a front face of the front portion 111, between the upper row and the lower row of the press-fit holes 113. The tabular rear projection 130 projects from a rear face of the rear portion 112, between the upper row and the lower row of the press-fit holes 113. A plurality of front receiving grooves 121 are formed in upper and lower surfaces of the front projection 120 in such an arrangement as to communicate with the press-fit holes 113 in the upper and lower rows. Similarly, a plurality of rear receiving grooves 131 are formed in upper and lower surfaces of the rear projection 130 in such an arrangement as to communicate with the press-fit holes 113 in the upper and lower rows.

Figure 4A:
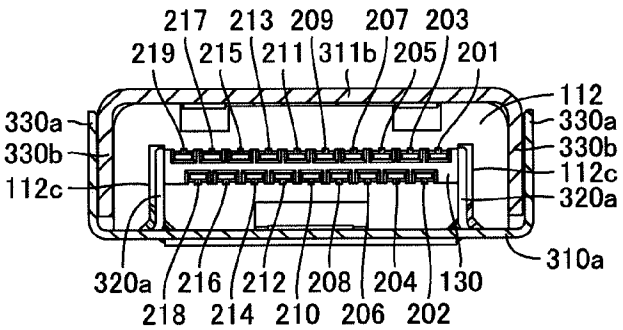
FIG. 4A is a schematic cross-sectional view along 4A-4A in FIG. 2A.
Figure 4B:
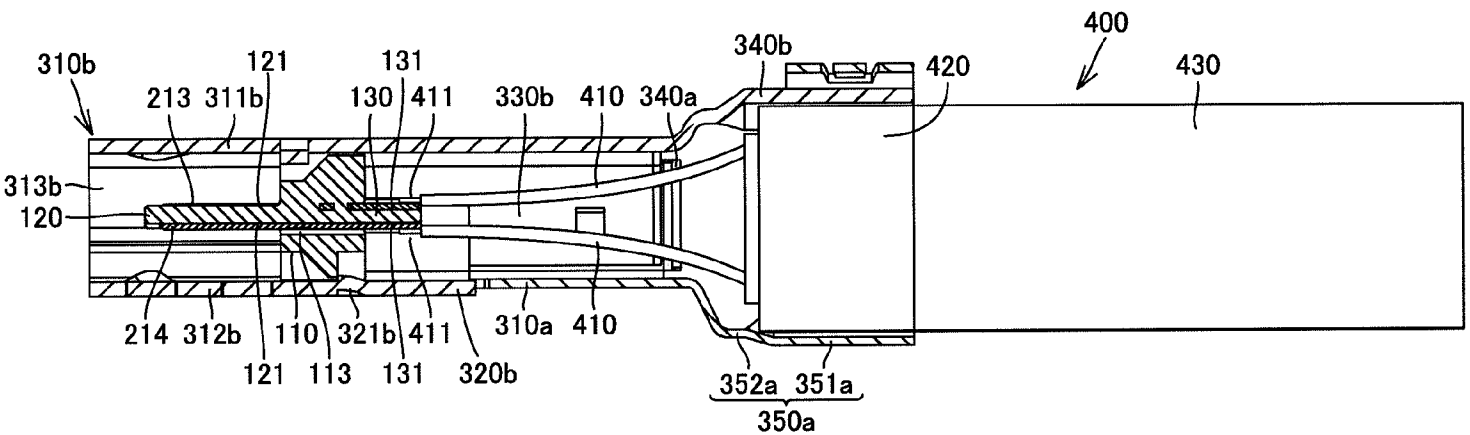
FIG. 4B is a schematic cross-sectional view along 4B-4B in FIG. 2A.
Figure 5A:
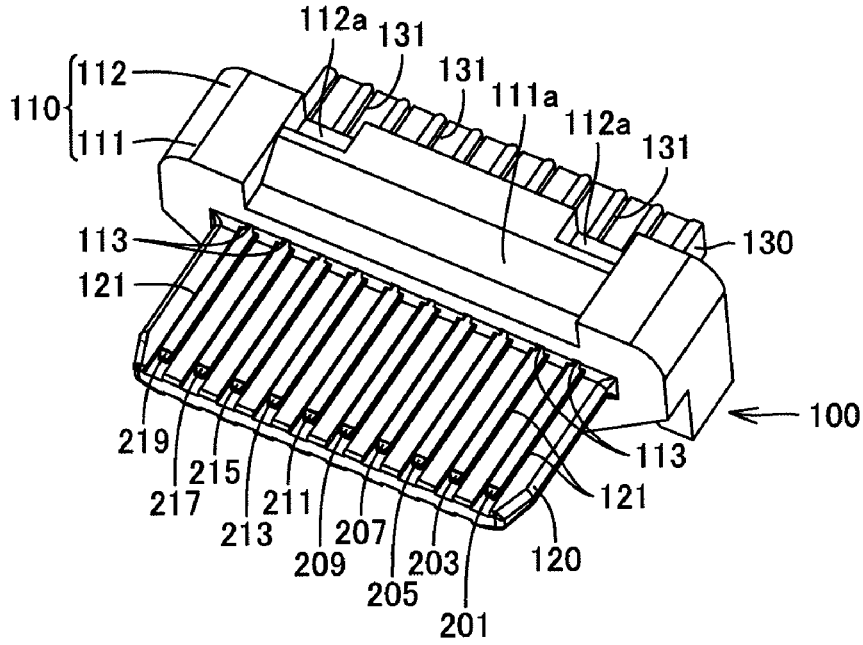
FIG. 5A is a schematic perspective view of a body with terminals of the connector, as seen from the front top right side.
Figure 5B:
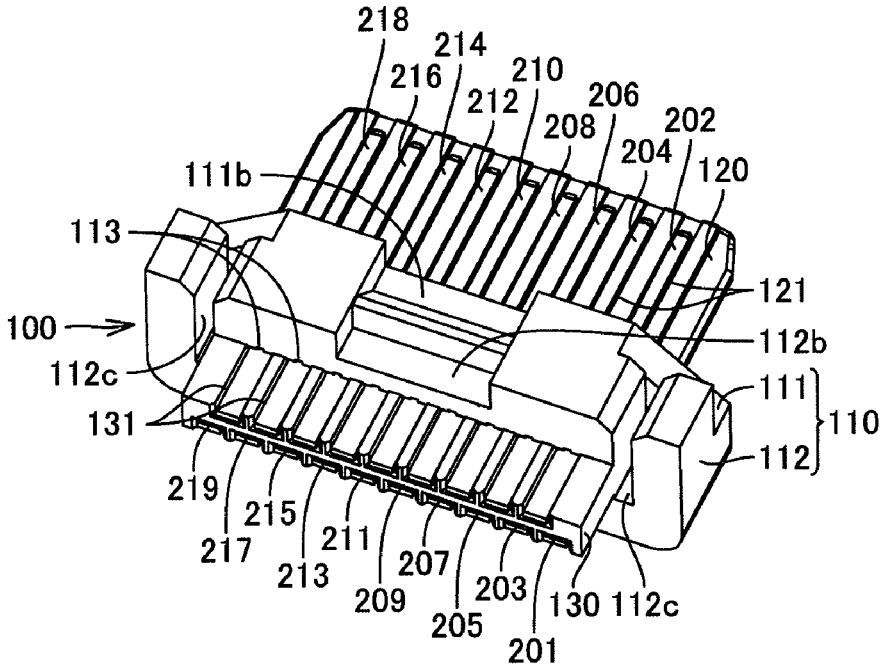
FIG. 5B is a schematic perspective view of the body with the terminals of the connector, as seen from the back bottom right side.

The terminal group 200 consists of terminals 201 to 219. Intermediate portions of the terminals 201 to 219 of the terminal group 200 are press-fitted into the press-fit holes 113. Front portions of the terminals 201 to 219 are received in the front receiving grooves 121, and rear portions of the terminals 201 to 219 are received in the rear receiving grooves 131. Therefore, the terminals 201 to 219 in two (upper and lower) rows form a staggered arrangement. Specifically, as shown in FIG. 4A, the terminals 201, 203, 205, 207, 209, 211, 213, 215, 217, 219 are arranged as the upper row, and the terminals 202, 204, 206, 208, 210, 212, 214, 216 are positioned in the lower row.

The adjacent terminals 201, 203 (second and first terminals) are differential signal terminals TMDS Data 2+ and TMDS Data 2−, respectively. That is, the terminals 201, 203 serve as a differential pair. The terminal 202 (third terminal) is a ground terminal serving as a reference for the terminals 201, 203, and it is positioned between the terminals 201, 203 in plan position. The terminal 201 is positioned at an end of the upper row of the terminal group 200. It should be noted here that the terminal 203 exists on the left side (in FIG. 4A) of the terminal 201, but there exists no other terminals on the right side of the terminal 201. The terminal 201 is therefore higher in impedance than the terminal 203. As the impedance is mismatched between the terminals 201, 203, impedance characteristics of the terminals 201, 203 are different from impedance characteristics of the terminals of other differential pairs (to be described).

The adjacent terminals 204, 206 are differential signal terminals TMDS Data 1+, TMDS Data 1−, respectively. That is, the terminals 204, 206 serve as a differential pair. The terminal 205 is a ground terminal serving as a reference for the terminals 204, 206, and it is positioned between the terminals 204, 206 in plan position. The adjacent terminals 207, 209 are differential signal terminals TMDS Data 0+, TMDS Data 0−, respectively. That is, the terminals 207, 209 serve as a differential pair. The terminal 208 is a ground terminal serving as a reference for the terminals 207, 209, and it is positioned between the terminals 207, 209 in plan position. The adjacent terminals 210, 212 are differential signal terminals TMDS Clock+, TMDS Clock−, respectively. That is, the terminals 210, 212 serve as a differential pair. The terminal 211 is a ground terminal serving as a reference for the terminals 210, 212, and it is positioned between the terminals 210, 212 in plan position.

The terminal 213 is a CEC terminal used for transmitting CEC signals as control data. The terminal 214 is reserved. The terminal 216 is a terminal used for SDA (Serial Data) signals such as E-EDID. The terminal 215 is used for transmitting SCL (Serial Clock) signals that serve as synchronization clock signals when sending and receiving the SDA signals. The terminal 217 is a CEC/DDC ground terminal. The terminal 218 is a power supply terminal. The terminal 219 is a Hot Plug Detect terminal for detecting connection of the present receptacle connector to a plug connector (not shown).

The cable 400 has a plurality of signal lines 410, a shield conductor 420, and a protection layer 430. The signal lines 410 each have a core 411 covered with an insulating resin layer. Front portions of the cores 411 are exposed from the insulating resin layers and connected by soldering to the respective rear portions of the terminals 201 to 219. The shield conductor 420 is a conductive braided wire tube covering all the signal lines 410. An end portion of the shield conductor 420 is exposed from the protection layer 430. The protection layer 430 is an insulating resin tube covering the shield conductor 420. The interior of the shield conductor 420 and the protection layer 430 is omitted from FIG. 4B.

In the main body 110 of the body 100, the top of the front portion 111 has an upper depression 111*a* extending in the width direction of the body 100, and the bottom of the front portion 111 has a lower depression 111*b* extending in the width direction. Far surfaces of the upper depression 111*a* and the lower depression 111*b* are inclined downward toward the front side. The rear portion 112 of the main body 110 has a pair of locking depressions 112*a* in its upper end portion, behind widthwise ends of the upper depression 111*a*. The rear portion 112 also has a locking depression 112*b* centrally in its lower end portion, behind the lower depression 111*b*. The locking depression 112*b* is of substantially the same width dimension as the lower depression 111*b*. The rear portion 112 further has a pair of slits 112*c* in lower end portions of widthwise ends of the rear portion 112. The slits 112*c* have enough depths to exist on the outer sides of the terminals 201, 219 (that is, on the opposite sides of the terminals 201, 219 from the terminals 203, 217, respectively) as shown in FIG. 4A.

Figure 6A:
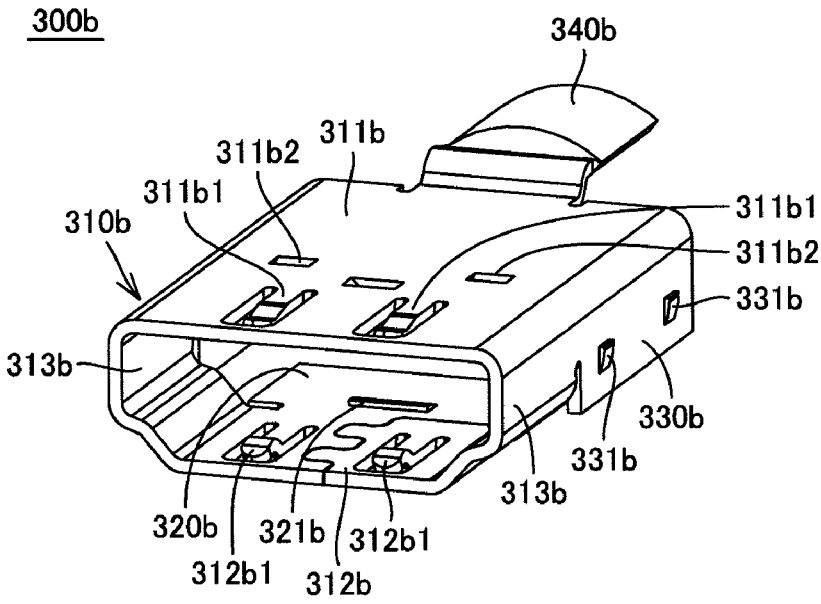
FIG. 6A is a schematic perspective view of a second outer shell of the connector, as seen from the front top right side.
Figure 6B:
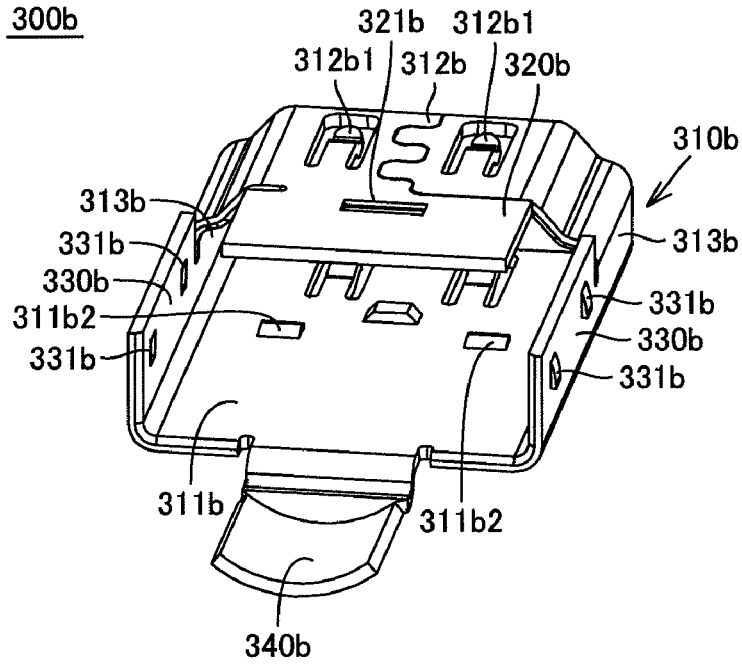
FIG. 6B is a schematic perspective view of the second outer shell of the connector, as seen from the back bottom right side.
Figure 7A:
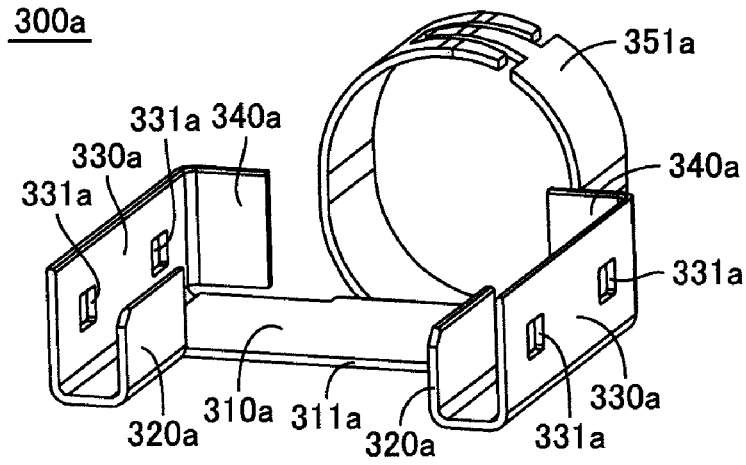
FIG. 7A is a schematic perspective view of a first outer shell of the connector, as seen from the front top right side.
Figure 7B:
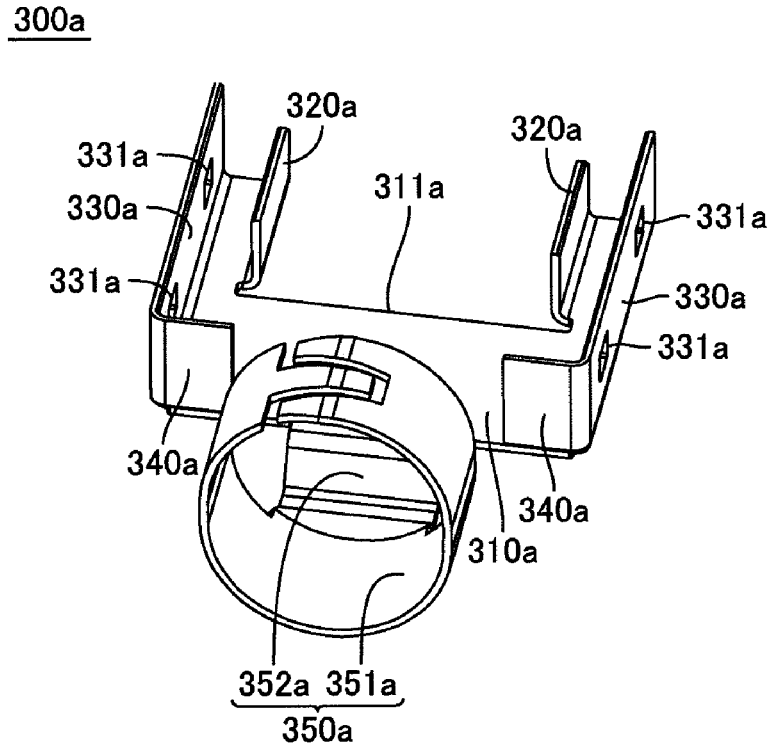
FIG. 7B is a schematic perspective view of the first outer shell of the connector, as seen from the back bottom right side.

The shield case 300 has first and second outer shells 300*a*, 300*b* formed of conductive metal plates. The first and second outer shells 300*a*, 300*b* are combined with each other, so as to serve as an outer shell to surround an peripheral surface of the body 100. As shown in FIGS. 6A and 6B, the second outer shell 300*b* has a tuboid containing portion 310*b*, a lid 320*b*, a pair of covers 330*b* (locking portions), and a connection portion 340*b*. The containing portion 310*b* has a top plate 311*b* (first plate), a bottom plate 312*b* (second plate), and a pair of side plates 313*b* (third and fourth plates). The top plate 311*b* is a rectangular plate facing the bottom plate 312*b*, the top plate being larger in length and width than the bottom plate 312*b*. The top plate 311*b* abut the upper surfaces of the front portion 111 and the rear portion 112 of the main body 110. The bottom plate 312*b* abuts the lower surface of the front portion 111 of the main body 110. The side plates 313*b* each connect each widthwise end of a front portion of the top plate 311*b* and each widthwise end of the bottom plate 312*b*, and they abut widthwise side surfaces of the front portion 111 of the main body 110. Lower end portions of the side plates 313*b* are inclined inward so as to conform a shape of the front portion 111. In short, an inner shape defined by the top plate 311*b*, the bottom plate 312*b*, and the pair of side plates 313*b* (i.e. inner shape of the containing portion 310*b*) is substantially hexagonal tuboid conforming to an outer shape of the front portion 111 of the main body 110 of the body 100. As the front portion 111 of the body 100 is fitted into the containing portion 310*b* from the rear side, the front projection 120 of the body 100 is received in the containing portion 310*b*. Also, the lower end portions of the widthwise end portions of the rear portion 112 of the main body 110 abut the inclined lower end portions of the side plates 313*b* from the rear side. A space defined by the containing portion 310*b* and the front portion 111 of the body 100 serves as a connection hole for receiving a connection portion of a plug connector.

The covers 330*b* of rectangular plate shape extend downward from widthwise ends of a rear portion of the top plate 311*b*. Inner surfaces of the covers 330*b* abut widthwise side surfaces of the rear portion 112 of the main body 110. A pair of locking projections 331*b* project outward from each of outer surfaces of the covers 330*b*. The connection portion 340*b* is provided continuously to a central rear end of the top plate 311*b*. The connection portion 340*b* has an arc-shaped rear portion to be brought into contact and electrical connection with the shield conductor 420 of the cable 400. The front portion of the top plate 311*b* have cut portions serving as a pair of locking pieces 311*b*1. Distal portions of the locking pieces 311*b*1 are bent downward into arc shapes. The bottom plate 312*b* also has cut portions serving as a pair of locking pieces 312*b*1. Distal portion of the locking pieces 312*b*1 are bent upward into arc shapes. The locking pieces 311*b*1, 312*b*1 elastically sandwich a connection portion of a plug connector inserted into the connection hole of the containing portion 310*b*. To the rearward of the locking pieces 311*b*1 of the top plate 311*b*, there is a pair of locking projections 311*b*2 projecting inwardly. The lid 320*b* is provided continuously to a rear end of the bottom plate 312*b*. The lid 320*b* is a rectangular plate to face the rear portion of the top plate 311*b*, and it abuts a lower surface of the rear portion 112 of the main body 110. The lid 320*b* has a locking projection 321*b*. The locking projections 311*b*2 are locked into the pair of locking depressions 112*a* of the body 100, and the locking projection 321*b* is locked into the locking depression 112*b* of the body 100. The front portion 111 of the body 100 is thus fittingly held in the containing portion 310*b*.

The first outer shell 300*a* has a base plate 310*a* (base), a pair of impedance adjusting plates 320*a* (impedance adjuster), a pair of locking plates 330*a* (locking portions), a pair of back plates 340*a*, and a connection portion 350*a*. The base plate 310*a* is a rectangular plate with an opening 311*a* in a front portion thereof. The opening 311*a* has a rectangular shape slightly larger than an outer shape of the lid 320*b* of the second outer shell 300*b*. The lid 320*b* fits into the opening 311*a* to close the opening 311*a*. Opposite edges of the opening 311*a* of the base plate 310*a* abut the lower surfaces of the widthwise ends of the rear portion 112 of the main body 110 of the body 100. The pair of rectangular impedance adjusting plates 320*a* stand on the edges of the opening 311*a* of the base plate 310*a*. The impedance adjusting plates 320*a* are inserted into the pair of slits 112*c* of the body 100, so that they are positioned adjacent to and outside the intermediate portions of the terminals 201, 219 (that is, on the opposite side of the terminals 201, 219 from the terminals 203, 217). A distance between the impedance adjusting plate 320*a* and the terminal 201 is determined so that impedance of the terminal 201 is substantially equal to impedance of the terminal 203.

The rectangular locking plates 330*a* stand on widthwise ends of the base plate 310*a* and extend in the same direction as the impedance adjusting plates 320*a*. The locking plates 330*a* each have a pair of locking holes 331*a*. The pairs of locking holes 331*a* are adapted to lockingly receive the pairs of locking projections 331*b* on the covers 330*b* of the second outer shell 300*b*. The first and second outer shells 300*a*, 300*b* are thus combined with each other and securely attached to the body 100. The rear ends of the locking plates 330*a* are provided with the back plates 340*a* bent inward at a right angle. A space between the back plates 340*a* serves as an insertion port to pass the signal lines 410 of the cable 400 therethrough. The connection portion 350*a* is provided continuously to a central rear end of the base plate 310*a*. The connection portion 350*a* has a connection portion body 351*a* of ring shape and a coupling plate 352*a* connecting the connection portion body 351*a* and a rear end of the base plate 310*a*. The connection portion body 351*a* is fitted over the connection portion 340*b* of the second outer shell 300*b* and the shield conductor 420 of the cable 400, so that connection portion body 351*a* is brought into contact and electrical connection with the shield conductor 420. That is, the first and second outer shells 300*a*, 300*b* are grounded through the shield conductor 420. Thus, the present connector has no floating ground.

The resin cases 500*a*, 500*b* are cup-shaped bodies made of insulating resin. The resin cases 500*a*, 500*b* are combined with each other so as to contain the body 100, the terminal group 200, and the shield case 300. The resin cases 500*a*, 500*b* have openings 510*a*, 510*b* in their front face to expose the connection hole of the containing portion 310*b* of the second outer shell 300*b*. Rear faces of the resin cases 500*a*, 500*b* have a lead-out hole (not shown) to lead out the cable 400.

The connector having the above-described configuration may be assembled in the following steps. First, the body 100 is prepared. Thereafter, the front portions and then the intermediate portions of the terminals 201 to 219 are inserted into the press-fit holes 113 of the body 100. Accordingly, the front portions of the terminals 201 to 219 are placed into the front receiving grooves 121 of the body 100, and the rear portions of the terminals 201 to 219 are placed into the rear receiving grooves 131 of the body 100. The next step is to prepare the cable 400. The protection layer 430 and the shield conductor 420 at an end of the cable 400 are cut away to expose the signal lines 410. The insulating resin layers of the exposed signal lines 410 are cut away to expose the cores 411. Further, an end portion of the protection layer 430 is cut away to expose the end portion of the shield conductor 420. Thereafter, the cores 411 of the signal lines 410 are connected by soldering to the respective rear end portions of the terminals 201 to 219. The next step is to prepare the second outer shell 300*b* fabricated by press-molding a conductive metal plate. Thereafter, the front portion 111 of the main body 110 of the body 100 is inserted and fitted into the containing portion 310*b* of the second outer shell 300*b* from the rear side. Upon the insertion, the upper surfaces of the front portion 111 and the rear portion 112 of the main body 110 abut the top plate 311*b* of the second outer shell 300*b*, the lower surface of the front portion 111 of the main body 110 abuts the bottom plate 312*b* of the second outer shell 300*b*, the lower surface of the rear portion 112 of the main body 110 abuts the lid 320*b*, the widthwise side surfaces of the front portion 111 of the main body 110 abut the side plates 313*b* of the second outer shell 300*b*, and the widthwise side surfaces of the rear portion 112 of the main body 110 abut the covers 330*b* of the second outer shell 300*b*. Simultaneously, the lower end portions of the widthwise end portions of the rear portion 112 of the main body 110 abut the lower end portions of the side plates 313*b* from the rear side, the pair of locking projections 311*b*2 of the top plate 311*b* goes beyond the far surface of the upper depression 111*a* of the body 100 and is locked into the pair of locking depressions 112*a*, and the locking projection 321*b* of the lid 320*b* goes beyond the far surface of the lower depression 111*b* of the body 100 and is locked into the locking depression 112*b*. A rear portion of the connection portion 340*b* is disposed to face the shield conductor 420 of the cable 400.

The next step is to prepare the first outer shell 300*a* produced by press-molding a conductive metal plate. The first outer shell 300*a* is configured at this time such that the connection portion body 351*a* of the connection portion 350*a* is yet to be curved into a ring shape. The pair of impedance adjusting plates 320*a* of the first outer shell 300*a* is positioned and inserted into the pair of slits 112*c* of the body 100. The inserted impedance adjusting plates 320*a* are placed adjacent to and on the outer side of the terminals 201, 219. Also, the lid 320*b* of the second outer shell 300*b* is placed into the opening 311*a* of the first outer shell 300*a*. The locking projections 331*b* on the pair of covers 330*b* of the second outer shell 300*b* are locked into the locking holes 331*a* in the pair of locking plates 330*a* of the first outer shell 300*a*. Thereafter, the connection portion body 351*a* is curved into a ring shape and fitted over the rear portion of the connection portion 340*b* of the second outer shell 300*b* and the shield conductor 420 of the cable 400. Consequently, the connection portion body 351*a* and the rear portion of the connection portion 340*b* are brought into contact and electrical connection with the shield conductor 420.

In the above-described connector, the impedance adjusting plates 320*a* of the first outer shell 300*a* are placed adjacent to the intermediate portion of the terminal 201 and on the opposite side of the terminal 201 from the terminal 203. Such arrangement makes it possible to lower the impedance of the terminal 201 without adding a separate component, so that the terminals 201, 203 are matched in impedance. As a result, impedance characteristics of the terminals 201, 203 are substantially the same as the impedance characteristics of the terminals of other differential pairs.

Further, the present connector is advantageously easy to assemble. More particularly, when the locking plates 330*a* of the first outer shell 300*a* are locked onto the covers 330*b* of the second outer shell 300*b*, the impedance adjusting plates 320*a* are received into the slits 112*c* of the body 100 and adjacent to and on the outer side of the terminals 201, 219. That is, the impedance adjusting plates 320*a* are disposed in place while combining the first and second outer shells 300*a*, 300*b*. Further, the impedance adjusting plates 320*a* stand on the edges of the opening 311*a* of the base plate 310*a*, and the lid 330*b* of the second outer shell 300*b* is adapted to fit in the opening 311*a*. Accordingly, the impedance adjusting plates 320*a* will not interfere with the containing portion 310*b* or the lid 330*b* of the second outer shell 300*b* when the connector is assembled. This configuration also contributes to simplified assembly operations of the present connector.

The receptacle connector of the invention is not limited to the one described as the above embodiment, but it may be modified in design within the scope of claims. Examples of modifications are described in detail below.

The first and second terminals of the above-described embodiment are the terminals 203, 201 of the differential pair positioned at an end of the upper row of the terminal group 200. However, the first and second terminals may be located at any positions in the terminal group as long as they are adjacent to each other and the second terminal has higher impedance than the first terminal. For example, the first and second terminals may be the terminals of the differential pair at an end of the lower row of the terminal group 200. It should be noted that the higher impedance of the second terminal than the first terminal may or may not be due to the fact that the second terminal is positioned at an end of the terminal group. The first and second terminals may be a differential pair as in the above embodiment, but the present invention is not limited thereto.

The shield case 300 may consist of the first and second outer shells 300*a*, 300*b* as in the above embodiment. The shield case may have any other configuration, as long as it has at least one conductive outer shell adapted to cover the peripheral surface of the body and an impedance adjuster provided in the outer shell adjacent to at least a portion of the second terminal and on the opposite side of the second terminal from the first terminal. For example, the outer shell may be a tuboid body of insulating material such as insulating resin and ceramic material, on an outer surface of which conductive metal may be deposited, or the outer shell may be conductive metal cast into a tuboid shape. If the outer shell has the first and second outer shells, they may be of an insulating material such as insulating resin and a ceramic material formed into a tuboid shape, on an outer surface of which conductive metal is deposited, or conductive metal cast into tuboid shape.

The first outer shell 300*a* may consist of a base plate 310*a* (base), a pair of impedance adjusting plates 320*a* (impedance adjuster), a pair of locking plates 330*a* (locking portions), a pair of back plates 340*a*, and a connection portion 350*a* as in the above embodiment. However, the first outer shell of the invention may be configured in any manner as long as it includes a base adapted to cover at least a portion of the rear portion of the main body. The opening 311*a* may provided in a front portion of the base plate 310*a*, as in the above embodiment, or at any other part of the base plate 310*a* of the first outer shell 300*a*. Alternatively, the opening may be provided in the containing portion 310*b* of the second outer shell 300*b*. The base plate 310*a* may be configured as described above, i.e., the edges of the opening 311*a* may abut the lower surfaces of the rear portion 112 of the main body 110. The base plate may be modified in design as long as it is adapted to cover at least a portion of the rear portion of the main body. For example, the base plate may be replaced with a base of tuboid shape to cover the peripheral surface of the rear portion of the main body and the rear projection.

The containing portion 310*b* of the second outer shell 300*b* may have the top plate 311*b*, the bottom plate 312*b*, and the pair of side plates 313*b* as in the above embodiment. The containing portion may be modified in design as long as it is of tuboid shape adapted to contain at least the front portion of the main body. The lid 320*b* may be provided continuously to the rear end of the bottom plate 312*b* as in the above embodiment, but the present invention is not limited thereto. The lid may be provided at any position of the containing portion. Alternatively, the lid may be provided in the base if the opening is provided in the containing portion.

The impedance adjuster may be the impedance adjusting plates 320*a* standing on the edges of the opening 311*a* in the base plate 310*a* of the first outer shell 300*a* as in the above embodiment. The impedance adjuster may or may not be tabular, and it may be in any configuration as long as it is provided in the outer shell and placed adjacent to at least a portion of the second terminal on the opposite side of the second terminal from the first terminal. For example, the impedance adjuster may be separately provided from the outer shell and attached to the outer shell by press-fitting, insert-molding or like means. The impedance adjuster may be provided on the edge of the opening formed in the base or the containing portion, or it may be provided in the lid for closing the opening of the containing portion or the base. If provided in the lid, the impedance adjuster may be received in the opening so as to be placed adjacent to the second terminal. The impedance adjuster may be configured like the impedance adjusting plates 320*a* of the above embodiment that are received in the slits 112*c* of the body 100. However, the impedance adjuster is only required to be placed adjacent to at least a portion of the second terminal and on the opposite side of the second terminal from the first terminal. For example, the impedance adjuster may be positioned outside the body and adjacent to at least a portion of the second terminal and on the opposite side of the second terminal from the first terminal. The impedance adjuster may be embedded in the body by insert-molding or the like method and positioned adjacent to at least a portion of the second terminal and on the opposite side of the second terminal from the first terminal.

The locking projections 331*b* on the pair of covers 330*b* of the second outer shell 300*b* may be locked into the locking holes 331*a* in the locking plates 330*a* (locking portion) of the first outer shell 300*a* as in the above embodiment. The invention includes any form of engagement between the locking portion and the cover as long as the locking portion is engageable with the cover. For example, the locking portion may be attached to the cover with electrically conductive adhesive, or the locking portion may be provided with a locking projection to be locked into a locking hole provided in the cover. The locking portion and the cover may or may not be tabular. The cover of the invention is not limited to the above embodiment wherein the covers 330*b* are extended downward from the widthwise ends of the rear portion of the top plate 311*b*. For example, the cover may be extended from a rear end of at least one of the side plates 313*b*. The locking portion and the cover may be omitted in a case where the base is configured to cover the rear portion of the main body as described above.

The invention is not limited to the above-described embodiment wherein the first and second outer shells 300*a*, 300*b* have the connection portions 350*a*, 340*b*. In a case where the first and second outer shells are combined with each other, at least one of the first and second outer shells is required to have a connection portion to be connected to the shield conductor of the cable. The connector portion (s) may have any configuration as long as connectable to the shield conductor. The connector portion (s) may be omitted in a case where the first and second outer shells are grounded through a shield case of a mating connector when connected to the mating connector.

The body 100 may have the main body 110, the front projection 120, and the rear projection 130 as in the above embodiment. The body may be modified in design as long as it is adapted to accommodate the terminal group and to be contained in the shield case. The slits 112*c* may provided in the widthwise end portions of the rear portion 112 of the main body 110 as in the above embodiment. Alternatively, the slits may be provided in any positions in the body, if positioned on the opposite side of the second terminal from the first terminal.

The materials, shapes, dimensions, arrangements, etc. of the respective elements of the receptacle connector of the above embodiment have been described by way of example only, and they may be modified in design in any manner as long as they provide similar functions. The present invention is not limited to receptacle connectors compliant with HDMI Type A standard as in the embodiment. The invention may be applied to connectors compliant with any other HDMI standard than the Type A, or with any other standard than HDMI standards. Furthermore, the present invention is applicable not only to receptacle connectors but also to plug connectors.

REFERENCE SIGNS LIST

- 100 body
  - 110 main body
    - 112*c* slit
    - 120 front projection
    - 130 rear projection
- 200 terminal group
  - 201 terminal (second terminal)
  - 202 terminal (third terminal)
  - 203 terminal (first terminal)
- 300 shield case
- 300*a* first outer shell
  - 310*a* base plate (base)
    - 311*a* opening
  - 320*a* impedance adjusting plate (impedance adjuster)
  - 330*a* locking plate (locking portion)
  - 340*a* back plate
  - 350*a* connection portion
- 300*b* second outer shell
  - 310*b* containing portion
    - 311*b* top plate (first plate)
    - 312*b* bottom plate (second plate)
    - 313*b* side plate (third and fourth plates)
  - 320*b* lid
  - 330*b* cover
  - 340*b* connection portion
- 400 cable
  - 410 signal line
  - 420 shield conductor

The invention claimed is:

1. A connector comprising:

a body having an insulating property;

a terminal group provided in the body; and a shield case having electrical conductivity, wherein the terminal group includes:

a first terminal, and a second terminal, being provided adjacent to the first terminal and having higher impedance than the first terminal, and the shield case includes:

an outer shell, configured to surround an peripheral surface of the body, and an impedance adjuster, provided at the outer shell and located adjacent to at least a portion of the second terminal and on an opposite side of the second terminal from the first terminal.

2. The connector according to claim 1, wherein the outer shell includes first and second outer shells, the body includes a main body, the main body including a front portion and a rear portion, the second outer shell includes a tuboid containing portion adapted to contain the front portion of the main body, the first outer shell includes a base adapted to cover at least a portion of the rear portion of the main body, an opening is provided in the base or the containing portion, a lid for closing the opening is provided in the containing portion or the base, and the impedance adjuster stands on an edge of the opening.

3. The connector according to claim 1, wherein the outer shell includes first and second outer shells, the body includes a main body, the main body including a front portion and a rear portion, the second outer shell includes a tuboid containing portion adapted to contain a front portion of the main body, the first outer shell includes a base adapted to cover at least a portion of a rear portion of the main body, an opening is provided in the base or the containing portion, a lid for closing the opening is provided in the containing portion or the base, and the impedance adjuster stands on the lid and is received in the opening.

4. The connector according to claim 2, wherein the base abuts a lower surface of the rear portion of the main body, the containing portion includes:

a first plate abutting upper surfaces of the front portion and the rear portion of the main body, a second plate shorter than the first plate, the second plate abutting a lower surface of the front portion of the main body, and third and fourth plates abutting opposite side surfaces of the front portion of the main body, and the second outer shell further includes:

a pair of covers provided continuously to the first plate or the third and fourth plates, the covers abutting opposite side surfaces of the rear portion.

5. The connector according to claim 3, wherein the base abuts a lower surface of the rear portion of the main body, the containing portion includes:

a first plate abutting upper surfaces of the front portion and the rear portion of the main body, a second plate shorter than the first plate, the second plate abutting a lower surface of the front portion of the main body, and third and fourth plates abutting opposite side surfaces of the front portion of the main body, and the second outer shell further includes:

a pair of covers provided continuously to the first plate or the third and fourth plates, the covers abutting opposite side surfaces of the rear portion.

6. The connector according claim 4, wherein the first outer shell further includes a pair of locking portions standing on the base, and the locking portions are locked to the covers.

7. The connector according claim 5, wherein the first outer shell further includes a pair of locking portions standing on the base, and the locking portions are locked to the covers.

8. The connector according to claim 2, wherein the terminal group comprises a plurality of terminals including the first terminal and the second terminal, the connector further comprises:

a cable including a plurality of signal lines, the signal lines being connected to the terminals, and a shield conductor covering the signal lines, and the first and second outer shells are in contact with each other, and at least one of the first and second outer shells further includes a connection portion to be brought into contact with the shield conductor.

9. The connector according to claim 2, wherein the body includes a slit on the opposite side of the second terminal from the first terminal, and the slit is adapted to receive the impedance adjuster.

10. The connector according to claim 3, wherein the body includes a slit on the opposite side of the second terminal from the first terminal, and the slit is adapted to receive the impedance adjuster.

11. The connector according to claim 1, wherein the impedance adjuster is embedded in the body.

12. The connector according to claim 1, wherein the terminal group has a plurality of terminals arrayed in first and second rows, the second terminal is positioned at an end of the terminals in the first or second row, and the first terminal is positioned in the same row as the second terminal and on an inner side from the second terminal.

13. The connector according to claim 8, wherein the terminals are arrayed in first and second rows, the second terminal is positioned at an end of the terminals in the first or second row, and the first terminal is positioned in the same row as the second terminal and on an inner side from the second terminal.

14. The connector according to claim 12, wherein the terminal group further includes a third terminal positioned in a different row from the first and second terminals and between the first and second terminals in plan position, and the first and second terminals serve as a differential pair.

15. The connector according to claim 13, wherein the terminal group further includes a third terminal positioned in a different row from the first and second terminals and between the first and second terminals in plan position, and the first and second terminals serve as a differential pair.

* * * * *